US010077546B2

(12) United States Patent
McAlpine

(10) Patent No.: US 10,077,546 B2
(45) Date of Patent: Sep. 18, 2018

(54) CARTRIDGE FOR A URINAL OUTLET

(71) Applicant: McAlpine & Co. Ltd., Glasgow, Strathclyde (GB)

(72) Inventor: James Edward McAlpine, Glasgow (GB)

(73) Assignee: MCAPLPINE & CO. LTD., Glasgow (GB)

( * ) Notice: Subject to any disclaimer, the term of this patent is extended or adjusted under 35 U.S.C. 154(b) by 0 days.

(21) Appl. No.: 15/467,625

(22) Filed: Mar. 23, 2017

(65) Prior Publication Data

US 2017/0284074 A1 Oct. 5, 2017

(30) Foreign Application Priority Data

Mar. 31, 2016 (GB) ..... 1605418.1

(51) Int. Cl.
*E03C 1/28* (2006.01)
*A47K 11/12* (2006.01)

(52) U.S. Cl.
CPC ..... *E03C 1/281* (2013.01); *A47K 11/12* (2013.01)

(58) Field of Classification Search
CPC . E03C 1/28; E03C 1/281; E03C 1/298; E03D 13/00; E03D 13/007; A47K 11/12
USPC ..... 4/144.1, 144.2, 309–311
See application file for complete search history.

(56) References Cited

U.S. PATENT DOCUMENTS 112,621 A 3/1871 Nott
149,489 A 4/1874 Lewis
263,180 A 8/1882 Jackson
267,156 A 11/1882 Cooper
277,888 A 5/1883 Connolly
294,489 A 3/1884 McCloskey
332,911 A 12/1885 Lane
340,202 A 4/1886 Edwards
526,666 A 9/1894 Marquis
535,872 A * 3/1895 Thomas ..... E03C 1/28 137/247.27
556,692 A 3/1896 Purves
640,666 A 1/1900 Knapp
765,697 A 7/1904 Bunting, Jr.
803,979 A 11/1905 Bonnell
851,513 A 4/1907 Guthrie et al.
875,587 A 12/1907 Morrison
877,309 A 1/1908 Emerson
951,795 A 3/1910 Berwanger
(Continued)

FOREIGN PATENT DOCUMENTS

AT 299824 7/1972
CH 636932 6/1983
(Continued)

OTHER PUBLICATIONS

"Search Report", GB Application No. 1605418.1, dated Aug. 17, 2017, 3 pages.

(Continued)

*Primary Examiner* — J. Casimer Jacyna
(74) *Attorney, Agent, or Firm* — Colby Nipper PLLC

(57) ABSTRACT

A removable cartridge for a low or zero water urinal outlet comprises a body comprising a side wall including one or more locking projections projecting out from the wall. One or more resilient elements are provided in the wall and each resilient element includes one of the locking projections.

10 Claims, 1 Drawing Sheet

(56) References Cited

U.S. PATENT DOCUMENTS

| | | | | |
|---|---|---|---|---|
| 1,134,866 | A | 4/1915 | Kavanagh | |
| 1,274,578 | A | 8/1918 | Nicholson | |
| 1,669,473 | A | 5/1928 | Kelso | |
| 1,731,431 | A | 10/1929 | Milton | |
| 1,751,877 | A | 3/1930 | Nance | |
| 1,781,719 | A | 11/1930 | Darling | |
| 1,848,521 | A | 3/1932 | Fleck | |
| 1,958,712 | A | 5/1934 | Nance | |
| 2,349,180 | A | 5/1944 | Lamont | |
| 2,444,340 | A | 6/1948 | Donahue | |
| 2,450,392 | A | 9/1948 | Donahue | |
| 2,567,639 | A | 9/1951 | Fulton | |
| 2,793,371 | A | 5/1957 | Vesconte | |
| 3,047,013 | A | 7/1962 | Baumbach | |
| 3,096,527 | A | 7/1963 | Eynon | |
| 3,181,801 | A | 5/1965 | Lung et al. | |
| 3,391,419 | A | 7/1968 | Thorne-Thomsen | |
| 3,400,446 | A | 9/1968 | Yulkowwski | |
| 3,428,295 | A | 2/1969 | Downey et al. | |
| 3,430,871 | A | 3/1969 | Ross | |
| 3,565,106 | A | 2/1971 | Baumbach | |
| 3,583,003 | A | 6/1971 | Thompson | |
| 3,651,826 | A | 3/1972 | Kojima | |
| 3,855,649 | A | 12/1974 | Morris et al. | |
| 3,911,508 | A | 10/1975 | Goldberg | |
| 4,103,367 | A | 8/1978 | Kaufer | |
| 4,158,897 | A | 6/1979 | Cocherel | |
| 4,218,785 | A | 8/1980 | Crawford | |
| 4,244,061 | A | 1/1981 | Webster et al. | |
| 4,321,713 | A | 3/1982 | Thompson | |
| 4,359,788 | A | 11/1982 | Liou | |
| 4,546,503 | A | 10/1985 | Casberg | |
| 4,594,739 | A | 6/1986 | Watts et al. | |
| 4,692,948 | A | 9/1987 | Martin | |
| 4,777,676 | A | 10/1988 | Ericson | |
| 4,860,390 | A | 8/1989 | Ohta | |
| 4,870,992 | A | 10/1989 | Irwin et al. | |
| 4,969,217 | A | 11/1990 | Gandini | |
| 5,039,135 | A | 8/1991 | Palmer | |
| 5,121,509 | A | 6/1992 | Juple | |
| 5,165,118 | A | 11/1992 | Cendrowski | |
| 5,265,281 | A | 11/1993 | McAlpine | |
| 5,418,983 | A | 5/1995 | Garguillo et al. | |
| 5,489,415 | A | 2/1996 | Vlahaki | |
| 5,535,455 | A | 7/1996 | Liu | |
| 5,662,138 | A | 9/1997 | Wang | |
| 5,692,248 | A | 12/1997 | Ball | |
| 5,711,037 | A | 1/1998 | Richardt et al. | |
| 5,819,328 | A | 10/1998 | Lewis | |
| 5,987,655 | A | 11/1999 | Smet | |
| 6,044,859 | A | 4/2000 | Davis | |
| 6,067,669 | A | 5/2000 | Peterson | |
| 6,151,722 | A | 11/2000 | Lubrano | |
| 6,173,459 | B1 | 1/2001 | Ball | |
| 6,195,819 | B1 | 3/2001 | Wang | |
| 6,401,266 | B1 * | 6/2002 | Mitchell | E03C 1/281 4/309 |
| 6,415,463 | B1 | 7/2002 | Slothower | |
| 6,450,544 | B2 | 9/2002 | Becker et al. | |
| 6,644,339 | B2 | 11/2003 | Gorges et al. | |
| 6,886,193 | B2 | 5/2005 | McAlpine | |
| 6,973,939 | B2 | 12/2005 | Gorges et al. | |
| 7,013,500 | B1 | 3/2006 | Lin | |
| 7,155,760 | B2 | 1/2007 | McAlpine | |
| 7,243,681 | B2 | 7/2007 | Dahm | |
| 7,575,022 | B2 | 8/2009 | Higgins | |
| 7,636,957 | B2 | 12/2009 | Funari | |
| D715,405 | S | 10/2014 | McAlpine | |
| 8,943,619 | B2 * | 2/2015 | Romero | E03D 13/00 4/144.1 |
| 9,222,247 | B2 * | 12/2015 | Muderlak | E03D 13/007 |
| 9,683,359 | B2 | 6/2017 | McAlpine | |
| 9,790,672 | B2 | 10/2017 | McAlpine et al. | |
| 9,915,058 | B2 | 3/2018 | McAlpine | |
| 2002/0069913 | A1 * | 6/2002 | Gorges | E03C 1/28 137/247.13 |
| 2002/0189675 | A1 | 12/2002 | Huber | |
| 2003/0182721 | A1 | 10/2003 | Li | |
| 2003/0196262 | A1 | 10/2003 | McAlpine | |
| 2004/0049846 | A1 | 3/2004 | Cornwall | |
| 2004/0177439 | A1 | 9/2004 | Nunez | |
| 2006/0080763 | A1 | 4/2006 | McAlpine | |
| 2006/0195976 | A1 | 9/2006 | McAlpine | |
| 2006/0207005 | A1 | 9/2006 | Janssen | |
| 2007/0079874 | A1 | 4/2007 | McAlpine | |
| 2007/0186337 | A1 | 8/2007 | Emr | |
| 2008/0022455 | A1 | 1/2008 | McAlpine | |
| 2009/0260154 | A1 | 10/2009 | Shoop et al. | |
| 2010/0005581 | A1 | 1/2010 | McAlpine | |
| 2010/0199412 | A1 | 8/2010 | McAlpine | |
| 2010/0205725 | A1 | 8/2010 | McAlpine | |
| 2011/0000014 | A1 | 1/2011 | Ball et al. | |
| 2013/0000766 | A1 * | 1/2013 | McAlpine | E03C 1/298 137/843 |
| 2013/0042405 | A1 | 2/2013 | Marotz et al. | |
| 2015/0299994 | A1 | 10/2015 | McAlpine et al. | |
| 2017/0016220 | A1 | 1/2017 | McKendrick et al. | |
| 2017/0233990 | A1 | 8/2017 | McAlpine et al. | |
| 2017/0241115 | A1 | 8/2017 | McAlpine | |
| 2017/0306598 | A1 | 10/2017 | McAlpine | |

FOREIGN PATENT DOCUMENTS

| | | |
|---|---|---|
| DE | 1815734 | 7/1969 |
| DE | 9301155 | 4/1993 |
| DE | 19915322 | 1/2001 |
| DE | 10037535 | 3/2002 |
| DE | 20118255 | 5/2002 |
| DE | 20118252 | 3/2003 |
| DE | 20302114 | 4/2003 |
| DE | 10261487 | 7/2004 |
| DE | 102006018019 | 10/2007 |
| EP | 0180451 | 5/1986 |
| EP | 0342819 | 4/1992 |
| EP | 1174549 | 1/2002 |
| EP | 1188870 | 3/2002 |
| EP | 1484453 | 12/2004 |
| EP | 1593784 | 11/2005 |
| EP | 1785077 | 11/2005 |
| EP | 1612337 | 1/2006 |
| EP | 1967665 | 9/2008 |
| EP | 1992746 | 11/2008 |
| EP | 2037051 | 3/2009 |
| EP | 2045403 | 4/2009 |
| EP | 2453065 | 5/2012 |
| EP | 2660398 | 3/2013 |
| FR | 2164018 | 7/1973 |
| GB | 830734 | 3/1960 |
| GB | 856064 | 12/1960 |
| GB | 1125196 | 8/1968 |
| GB | 1220982 | 1/1971 |
| GB | 2070093 | 9/1981 |
| GB | 2174899 | 11/1986 |
| GB | 2285460 | 7/1995 |
| GB | 2319540 | 5/1998 |
| GB | 2321067 | 7/1998 |
| GB | 2329332 | 3/1999 |
| GB | 2373182 | 9/2002 |
| GB | 2334885 | 11/2002 |
| GB | 2423709 | 9/2006 |
| NL | 1032117 | 1/2008 |
| WO | 9907953 | 2/1999 |
| WO | 0177448 | 10/2001 |
| WO | 2004100742 | 11/2004 |
| WO | 2006043301 | 4/2006 |
| WO | 2007099356 | 9/2007 |
| WO | 2007110595 | 10/2007 |
| WO | 2008006234 | 1/2008 |
| WO | 2008144951 | 12/2008 |
| WO | 2009040524 | 4/2009 |
| WO | 2010107723 | 9/2010 |

(56) References Cited

FOREIGN PATENT DOCUMENTS

| | | |
|---|---|---|
| WO | 20100140761 | 12/2010 |
| WO | 2013184078 | 12/2013 |
| WO | 2014087151 | 6/2014 |

OTHER PUBLICATIONS

"Advisory Action", U.S. Appl. No. 12/679,755, dated Mar. 11, 2016, 3 pgs.
"Advisory Action", U.S. Appl. No. 12/679,783, dated Jul. 8. 2015, 3 pgs.
"Advisory Action", U.S. Appl. No. 12/679,783, dated Sep. 12, 2017, 3 pgs.
"Advisory Action", U.S. Appl. No. 14/002,766, dated Sep. 25, 2017, 3 pgs.
"Advisory Action", U.S. Appl. No. 12/679,755, dated Apr. 17, 2015, 4 pgs.
"Examination Report Under Section 18(3)", U.S. Appl. No. 14/650,380, dated Nov. 1, 2016, 4 pgs.
"Examiner's Answer to Appeal Brief", U.S. Appl. No. 10/556,716, dated Mar. 2, 2011, 7 pgs.
"Final Office Action", U.S. Appl. No. 12/679,755, dated Aug. 14, 2013, 11 pgs.
"Final Office Action", U.S. Appl. No. 12/281,288, dated Aug. 3, 2011, 12 pgs.
"Final Office Action", U.S. Appl. No. 12/679,783, dated Oct. 6, 2016, 12 pgs.
"Final Office Action", U.S. Appl. No. 12/679,783, dated Feb. 2, 2015, 13 pgs.
"Final Office Action", U.S. Appl. No. 14/002,766, dated Apr. 21, 2016, 15 pgs.
"Final Office Action", U.S. Appl. No. 12/679,783, dated May 3, 2016, 16 pgs.
"Final Office Action", U.S. Appl. No. 14/002,766, dated Jun. 20 2017, 17 pgs.
"Final Office Action", U.S. Appl. No. 10/624,202, dated Jun. 24, 2005, 5 pgs.
"Final Office Action", U.S. Appl. No. 11/538,759, dated Apr. 21, 2008, 6 pgs.
"Final Office Action", U.S. Appl. No. 10/556,716, datd Nov. 13, 2008, 6 pgs.
"Final Office Action", U.S. Appl. No. 11/2245,484, dated Dec. 22, 2008, 6 pgs.
"Final Office Action", U.S. Appl. No. 12/679,755, dated Mar. 11, 2016, 8 pgs.
"Final Office Action", U.S. Appl. No. 14/650,380, dated May 2, 2017, 8 pgs.
"Final Office Action", U.S. Appl. No. 15/123,826, dated Jun. 11, 2018, 9 pgs.
"Final Office Action", U.S. Appl. No. 11/538,759, dated Jul. 10, 2009, 9 pgs.
"Final Office Action", U.S. Appl. No. 12/679,755, dated Oct. 28, 2014, 9 pgs.
"Foreign Office Action", EP Application No. 08806393.8, dated Apr. 4, 2014, 5 pgs.
"International Search Report and Written Opinion", PCT Application No. PCT/GB2015/052768, dated Jan. 5, 2016, 10 pgs.
"International Search Report and Written Opinion", PCT Application No. PCT/GB2015/052766, dated Jan. 5, 2016, 14 pgs.
"Non-Final Office Action", U.S. Appl. No. 12/679,755, dated Jul. 2, 2015, 10 pgs.
"Non-Final Office Action", U.S. Appl. No. 12/679,755, dated Dec. 19, 2012, 10 pgs.
"Non-Final Office Action", U.S. Appl. No. 12/679,783, dated Oct. 6, 2016, 11 pgs.
"Non-Final Office Action", U.S. Appl. No. 14/002,766, dated Sep. 23, 2015, 12 pgs.
"Non-Final Office Action", U.S. Appl. No. 15/493,396, dated Jun. 4, 2018, 13 pgs.
"Non-Final Office Action", U.S. Appl. No. 12/679,783, dated Apr. 11, 2014, 14 pgs.
"Non-Final Office Action", U.S. Appl. No. 12/679,783, dated Sep. 11, 2015, 14 pgs.
"Non-Final Office Action", U.S. Appl. No. 12/281,288, dated Nov. 12, 2010, 15 pgs.
"Non-Final Office Action", U.S. Appl. No. 14/002,766, dated Jan. 26, 2017, 21 pgs.
"Non-Final Office Action", U.S. Appl. No. 10/624,202, dated Feb. 8, 2005, 4 pgs.
"Non-Final Office Action", U.S. Appl. No. 10/382,730, dated Jun. 17, 2004, 4 pgs.
"Non-Final Office Action", U.S. Appl. No. 11/538,759, dated Sep. 30, 2008, 4 pgs.
"Non-Final Office Action", U.S. Appl. No. 10/624,202, dated Jan. 13, 2006, 5 pgs.
"Non-Final Office Action", U.S. Appl. No. 10/556,716, dated Apr. 28, 2009, 5 pgs.
"Non-Final Office Action", U.S. Appl. No. 10/624,202, dated May 19, 2004, 5 pgs.
"Non-Final Office Action", U.S. Appl. No. 10/556,716, dated May 15, 2008, 6 pgs.
"Non-Final Office Action", U.S. Appl. No. 11/538,759, dated Sep. 4, 2007, 6 pgs.
"Non-Final Office Action", U.S. Appl. No. 11/538,759, dated Jan. 29, 2010, 7 pgs.
"Non-Final Office Action", U.S. Appl. No. 11/245,484, dated May 1, 2008, 7 pgs.
"Non-Final Office Action", U.S. Appl. No. 12/679,755, dated Aug. 12, 2016, 8 pgs.
"Non-Final Office Action", U.S. Appl. No. 11/830,111, dated Aug. 29, 2011, 8 pgs.
"Non-Final Office Action", U.S. Appl. No. 15/123,826, dated Oct. 2, 2017, 8 pgs.
"Non-Final Office Action", U.S. Appl. No. 12/679,755, dated Jan. 29, 2014, 9 pgs.
"Non-Final Office Action", U.S. Appl. No. 15/512,779, dated Jan. 12, 2018, 9 pgs.
"Non-Final Office Action", U.S. Appl. No. 15/512,804, dated Nov. 27, 2017, 9 pgs.
"Non-Final Office Action", U.S. Appl. No. 12/679,783, dated May 22, 2013, 9 pges.
"Notice of Allowance", U.S. Appl. No. 12/679,755, dated Feb. 22, 2017, 8 pgs.
"Notice of Allowance", U.S. Appl. No. 12/679,783, dated Nov. 14, 2017, 8 pgs.
"Notice of Allowance", U.S. Appl. No. 14/650,380, dated Jul. 6, 2017, 8 pgs.
"Notice of Allowance", U.S. Appl. No. 14/002,766, dated Oct. 30, 2017, 9 pgs.
"Partial Search Report", EP Application No. 17167956, dated Oct. 30, 2017, 3 pgs.
"Preinterview First Office Action", U.S. Appl. No. 14/650,380, dated Feb. 3, 2017, 5 pgs.
"Preliminary Report on Patentability", PCT Application No. PCT/GB2007/000756, dated Sep. 2, 2008, 8 pgs.
"Requirement for Restriction/Election", U.S. Appl. No. 14/650,380, dated Nov. 14, 2016, 7 pgs.
"Search Opinion", EP Application No. 17167956.6, dated Oct. 30, 2017, 4 pgs.
"Search Report", PCT Application No. PCT/GB2008/003229, dated Jan. 16, 2009, 3 pgs.
"Supplemental Notice of Allowance", U.S. Appl. No. 14/002,766, dated Nov. 15, 2017, 5 pgs.
"Written Opinion", PCT Application No. PCT/GB2007/000756, dated Feb. 9, 2008,7 pgs.

* cited by examiner

CARTRIDGE FOR A URINAL OUTLET

FIELD OF THE INVENTION

The present invention relates to a cartridge for a urinal outlet. Particularly, but not exclusively, the present invention relates to a cartridge for a low or zero water usage urinal.

BACKGROUND TO THE INVENTION

Typically, urinals use relatively high volume of water for flushing urine away; particularly, urinals, which are on a flush cycle where the urinal is flushed with clean water at timed intervals regardless of whether or not the urinal has been used. By flushing the urinal, the intention is that urine in the bowl is flushed away to a drain and thus struvite (urine stone) build up is reduced and odour from the urine feeding back through the urinal outlet is minimised.

In the situation of a low water or waterless urinal the outlet from the urinal can suffer from a build-up of struvite and calcium phosphate. The urinal bowl is generally robust and comprises a mounted ceramic or porcelain fixture on wall of a bathroom or washroom. Due to the low or zero water nature of the urinal there is no constant flow of flush water to clean the urinal and the associated drainage components. The main functional components in a low or zero water urinal relate to draining fluids away and preventing odours from emanating from the urinal.

A build-up of struvite and/or calcium phosphate provides a substance which adheres to fittings within the urinal and at its outlet. The deposits of struvite and/or calcium phosphate provide a medium upon which raw urine can adhere and therefore over a period of time foul odours may emanate from the urinal.

It will be appreciated that, typically, the urinal outlet area is provided with disposable components, which typically can be removed, replaced and/or cleaned to avoid the build-up of struvite, calcium phosphate and the like and to keep odours at a minimum.

SUMMARY OF THE INVENTION

According to a first aspect of the present invention there is provided a removable cartridge for a low or zero water urinal outlet, the cartridge comprises: a body comprising a side wall including one or more locking projections projecting outwardly from the wall, and one or more resilient elements provided in and defined by the wall and wherein each resilient element includes a locking projection.

In use the cartridge is inserted into a drain housing provided as part of a urinal. To lock the cartridge in place, the cartridge is located such that the projections locate in L-shaped slots provided in the housing. Once a locking projection locates with the base of the ascender portion of the L-shape slot the cartridge is rotated in one direction, for example clockwise, such that the locking projections are guided along the arm of the L-shaped slot to lock the cartridge in place. Similarly, to remove the cartridge, it is rotated in the opposite direction such that the locking projections travel along the arm of the L-shaped slot until reaching the base of the ascender portion of the L-shaped slot, which provides the exit path for the locking projection and allows the cartridge to be extracted.

The arrangement of the locking projections and the resilient element is such that upon insertion of the cartridge into the urinal outlet the resilient element springs to prevent the locking projections getting jammed during the insertion (locking) or extraction (unlocking) process. In the event that the cartridge becomes jammed, for example due to a build-up of struvite or calcium phosphate, the resilience of the resilient elements will assist in overcoming the effect of the obstruction jamming the cartridge in place. The action of rotating the cartridge and the pressure applied to the resilient member by the locking projection trying to release would be sufficient to overcome an obstruction within the urinal drainage housing, for example due to a build-up of struvite or calcium carbonate.

The resilient member may comprise a cantilevered section of the wall defined between two elongated slots wherein one end of the cantilevered section provides a support about which an opposite free end of the cantilevered section can be displaced due to the interaction of the locking projections with the housing.

The locking projections may be located substantially central of the cantilevered section. Alternatively, the projections maybe located between centre of the cantilevered section and the free end of the cantilevered section. Alternatively, the projections may be located at or near the free end. The locking projections make contact with inside a housing provided at the outlet of the urinal and the cantilevered section responds by flexing due to interaction of the locking projections with any unevenness or obstructions on the housing wall.

The locking projections may comprise a tapered profile. The tapered profile may act to guide the locking projections into engagement with a corresponding keyway provided in the housing in which the cartridge is to be inserted. In an example where the cartridge includes a plurality of locking projections, for example three, each locking projection may be of a different size and shape than the adjacent locking projection. As such, the locking projections may each act as an indicator of how, and in which orientation, the cartridge should be inserted into the urinal drain.

The cartridge may further comprise a detachable key. The key may engage with the cartridge body to facilitate insertion, locking, unlocking and removal of the cartridge from the urinal drain housing.

The key and the cartridge may each comprise locating elements which are lockingly engageable such that the key is operable to locate and rotate the cartridge into and out of locking engagement with the urinal drain housing. In one example, the cartridge may comprise two or more slots and the key comprises two or more pins, which can be located in the slots and rotated to lock the key and cartridge together to operate as one unit. Alternatively, the key comprises two or more slots and the cartridge comprises two or more pins. The slot may be L-shaped. Alternatively, the slot may comprise an inverted T-shape, comprising a single descending portion and two arms extending in opposite directions from a base of the descending portion. An L-shape or T-shape slot provides locking engagement between the key and the cartridge such that the key and cartridge operate as one unit whilst inserting and extracting the cartridge from the urinal.

BRIEF DESCRIPTION OF THE DRAWINGS

Embodiments of the present invention will now be described with reference to the accompanying drawings in which.

DETAILED DESCRIPTION OF THE DRAWINGS

Figures 1, 2, 3:
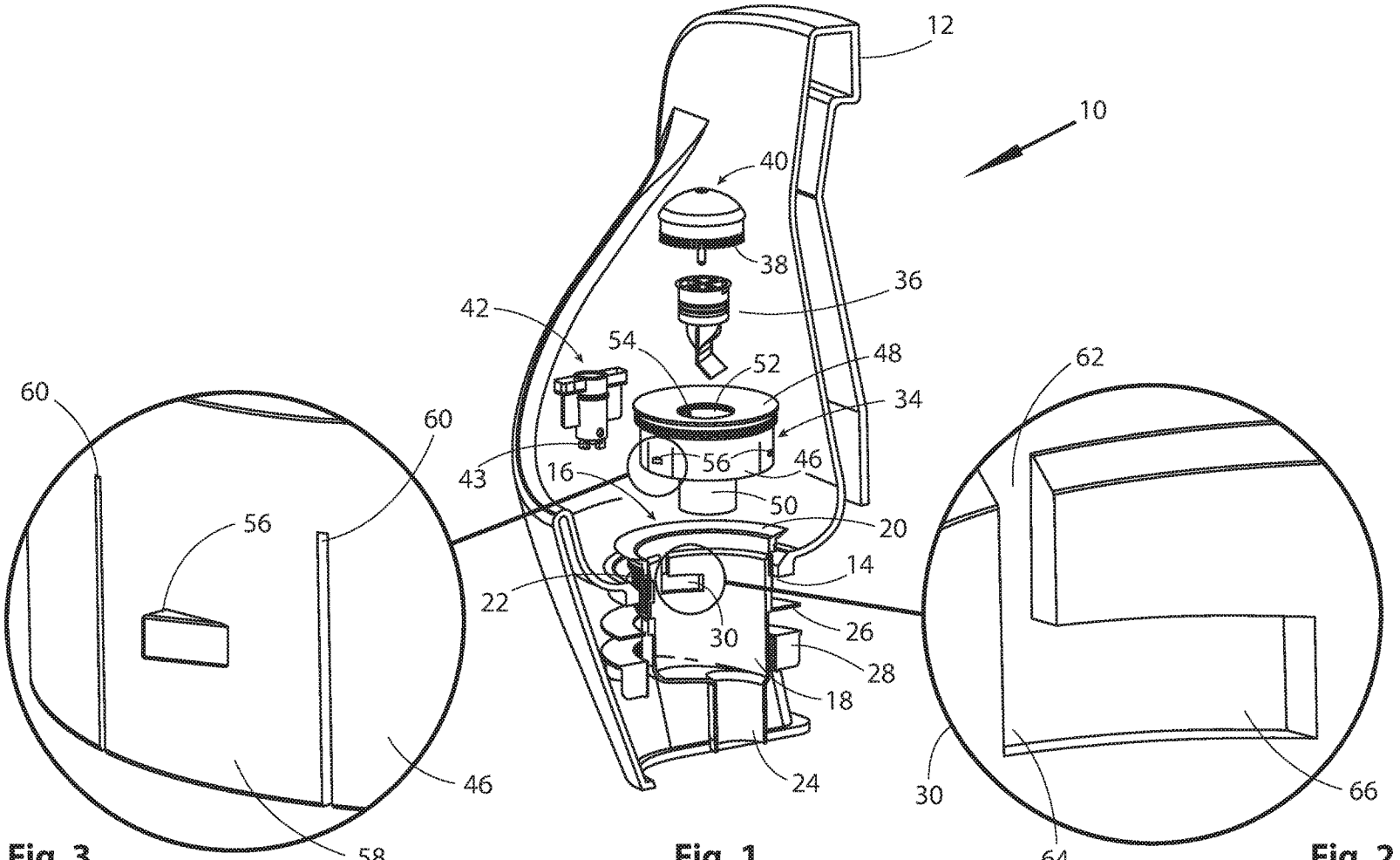
FIG. 1 is a schematic representation of an exploded view of a urinal unit comprising a cartridge according to an embodiment of the present invention.
FIG. 2 is a magnified view of a schematic representation of a drain housing included in FIG. 1.
FIG. 3 is a magnified view of a schematic representation of a locking projection included in FIG. 1.

FIG. 1 illustrates a cross sectional perspective view of a urinal 10. In the illustrated example the urinal 10 is indicative of a low or zero water urinal, which means that minimal or no flushing is not required. The urinal 10 comprises a ceramic or porcelain body 12, which is fixed to a suitable surface in a bathroom or washroom. The fixing arrangement is not included in the illustrated example.

The urinal 10 includes an outlet 14 into which is located a urinal drain housing 16. The urinal drain housing 16 is shown as a hollow body 18 comprising a sloped flange 20 at the upper end and a threaded portion 22 depending from the flange 20. The threaded portion 22 is received through the outlet 14. A pipe or tube 24 depends from the threaded portion 22 and facilitates removal of urine from the urinal, via suitable pipework, to a suitable location such as a sewer.

A scaling element 26 and a threaded collar 28 are located at the underside of the urinal 10 and are attached to the threaded portion 22 to facilitate sealing connection of the drain housing 16 to the urinal 10.

In the illustrated example, three L-shaped slots 30 are provided on the inside wall of the drain housing 16. Only one L-shaped slot is visible in FIG. 1, but it will be appreciated in the illustrated example that the three slots are circumferentially distributed around the housing 16. An enlarged view of an L-shaped slot 30 is illustrated in FIG. 2.

The urinal assembly illustrated in FIG. 1 includes disposable or consumable components or at least components that can be removed for routine cleaning and/or maintenance of the urinal 10. In the illustrated example, the removable components include a cartridge 34, an odour control valve 36, a filter 38 and a deodorising unit 40.

A key 42 is also illustrated in FIG. 1. The key 42 is used to insert and extract the cartridge 34 and a trap (when used) from the housing 16. This feature will be discussed further below.

The trap and cartridge 34 are inserted into the housing 16. Once these are locked in place, as described below, the odour control valve 36, the filter 38 and the deodorising unit 40 can be inserted into an outlet 52 provided in the cartridge 34.

According to an embodiment of the present invention the cartridge 34 and a trap can be provided as a single unit, or can be provided as two separate components, which are assembled in the housing.

In the illustrated example, the cartridge 34 includes a sleeve 46 which depends from an upper flange 48. The flange 48 includes a downwardly sloping surface to aid in directing urine to the outlet.

A pipe 50 depends from the flange 48 and an outlet 52 is provided through the flange 48. The outlet 52 allows urine to pass down through the drainage components and to exit the urinal 10.

In the illustrated example, two L-shaped slots 54 are provided on the upper edge of the outlet 52. Each of the L-shaped slots 54 facilitate connection of the key 42 to the cartridge 34 to facilitate insertion, locking, unlocking and extraction of the cartridge 34 to/from the housing. The key includes two lugs 43. Each lug 43 locates in the ascending portion of a corresponding slot 54 and upon the lug 43 reaching the base of the ascending portion of the slot 54 the key 42 can be rotated to lock the key 42 to the cartridge 34 for inserting and extracting the cartridge 34 into/from the housing 16.

In the illustrated example, the sleeve 46 includes three locking projections 56 that project from the outside surface of the sleeve 46. Each projection 56 is configured to locate in one of the L-shaped slots 30 provided in the drain housing 16. Each projection 56 is provided on a resilient section 58 of the sleeve 46, where each resilient section 58 is defined by a section of the wall between two slots 60 (see FIG. 3). Each slot 60 extends through the wall of the sleeve 46 and upwards from the free end/bottom 62 of the sleeve 46 such that a cantilevered section is defined. The resilient section 58 makes for easier insertion and extraction of the cartridge 34 because the resilient section 58 springs when the projection 56 meets with unevenness or an obstruction in its path and as such the resulting movement of the resilient section 58 allows the projection 56 to pass over unevenness within the housing 16, for example due to manufacturing processes or due to a build-up of struvite or calcium phosphate.

In the illustrated example, in accordance with an embodiment of the present invention the cartridge 34 includes three locking projections 56. Only two projections 56 are visible in FIG. 1 and a single locking projection 56 is illustrated in FIG. 3.

With reference to FIGS. 2 and 3, the projections 56 are arranged on the body of the cartridge 34 to locate in the ascending portion 62 of the L-shaped slots 30 and once the projections 56 reach the base 64 of the ascending portion 62, the cartridge 34 is rotated such that the projection 56 follows the path defined by the arm section 66 of the L-shaped slot 30. This action locks the cartridge 34 relative to the housing 16.

By reverse action, the cartridge 34 can be removed from the housing 16, wherein the key 42 can be engaged with the cartridge and upon reverse rotation the projections 56 will follow the path defined by the arm 66 until the projection reaches the base 64, which is coincident with the junction of the ascending portion 62 and the arm 66. At this point the cartridge can be extracted by lifting it out using the attached key 42. It will be appreciated that the configuration of the resilient section 58 means that the resilient section 58 will give if it meets with unevenness or an obstruction, for example a build-up of struvite or calcium carbonate; as such ease of removal of the cartridge is improved and incidences of the cartridge jamming is reduced.

Whilst specific embodiments of the present invention have been described above, it will be appreciated that departures from the described embodiments may still fall within the scope of the present invention.

The invention claimed is:

1. A removable cartridge for a low or zero water urinal outlet, the removable cartridge comprises:

a body comprising a side wall, said side wall comprising a plurality of resilient elements, each resilient element formed as a cantilevered section of the side wall defined between a pair of elongated slots in the side wall, wherein each resilient element further comprises one or more locking projections projecting out from the resilient element, wherein one end of each cantilevered section provides a support about which an opposite free end of the cantilevered section can be displaced upon rotation of the body and due to the interaction of at least one of the locking projections with an internal surface of a urinal outlet, and wherein engagement of the locking projections with unevenness or an obstruction on the internal surface of the urinal outlet facilitates springing of the cantilevered section thereby facilitating release and removal of the removable cartridge from the urinal outlet.

2. The removable cartridge as claimed in claim 1, wherein the locking projections are located substantially central on the cantilevered section.

3. The removable cartridge as claimed in claim 1, wherein the locking projections are located between a centre of the cantilevered section and the free end of the cantilevered section.

4. The removable cartridge as claimed in claim 1, wherein the locking projections are located at or near the free end of the cantilevered section.

5. The removable cartridge as claimed in claim 1, wherein the locking projections comprise a tapered profile.

6. The removable cartridge as claimed in claim 1, further comprising a detachable key.

7. The removable cartridge as claimed in claim 6, wherein the detachable key is engageable with the body to facilitate insertion, locking, unlocking and removal of the removable cartridge from a urinal outlet.

8. The removable cartridge as claimed in claim 7, wherein the removable cartridge comprises two or more locating slots and the detachable key comprises two or more lugs, which can be located in a corresponding one of said locating slots to facilitate rotation of the detachable key and removable cartridge together as one unit.

9. The removable cartridge as claimed in claim 8, wherein the locating slots are L-shaped, comprising an ascending portion and an arm portion, wherein a lug locates in an ascending portion and slides relative to the arm portion upon rotation of the detachable key thereby locking the detachable key relative to the body.

10. The removable cartridge as claimed in claim 1, further comprising a detachable key, wherein the detachable key is engageable with the body to facilitate insertion, locking, unlocking and removal of the removable cartridge, wherein removal of the removable cartridge is by locking together the detachable key and the body, rotating the body via the locked detachable key and by lifting, the removable cartridge from a urinal outlet, wherein the locking projections comprise a tapered profile, and wherein the removable cartridge comprises two or more locating slots and the detachable key comprises two or more lugs, wherein a lug can be located in a locating slot to facilitate rotation of the detachable key and removable cartridge together as one unit.

* * * * *